United States Patent [19]

Hood

[11] 3,937,367

[45] Feb. 10, 1976

[54] GAS CHARGED SPRAYER

[76] Inventor: Charles B. Hood, c/o Chardon Laboratories, Inc. P.O. Box 1004, Columbus, Ohio 43216

[22] Filed: May 27, 1975

[21] Appl. No.: 580,765

[52] U.S. Cl. ..... 222/399; 141/17; 239/308; 239/373

[51] Int. Cl.[2] ..... B65D 83/06

[58] Field of Search ..... 239/307, 308, 373; 222/399, 373, 130; 141/17, 19

[56] References Cited

UNITED STATES PATENTS

| | | | |
|---|---|---|---|
| 2,794,452 | 6/1957 | Quam | 239/373 X |
| 3,109,558 | 11/1963 | Yetter | 222/399 X |
| 3,262,609 | 7/1966 | Poitras | 222/399 |

*Primary Examiner*—John J. Love
*Attorney, Agent, or Firm*—William S. Rambo

[57] ABSTRACT

A manually portable spray tank includes a plug-like adapter mounted in the filler opening or mouth of the tank to receive and hold a pressurized can or canister containing a liquid propellant. The adapter includes a depending, elongated heat exchanger tube or trap which is closed at its lower end and which extends almost to the bottom of the tank for direct heat exchange contact with the liquid contained in the tank. Liquid propellant under pressure flows from the supply can into the heat exchanger tube or trap where it is vaporized by heat from the spray liquid in the tank. The vaporized propellant then passes under relatively high pressure outwardly through a comparatively small opening in the upper end of the heat exchanger tube into the ullage of the tank to pressurize the column of spray liquid in the tank and thereby insure its forcible discharge from the outlet of the spray tank.

4 Claims, 3 Drawing Figures

GAS CHARGED SPRAYER

BACKGROUND OF THE INVENTION

This invention relates generally to portable sprayers, and more particularly to an improved gas-charged sprayer for discharging a liquid detergent, or like solution, under moderately high pressures.

Conventional garden sprayers of the stirrup pump-type include a liquid-receiving tank having a dip tube extending to near the bottom of the tank and connected to a flexible hose having a valve-controlled nozzle at its outer end. The stirrup pump forces air into the tank to pressurize the contents. The spray liquid is forced from the tank and out through the spray nozzle. As the level of the liquid in the tank decreases, the pressure of the air above the remaining liquid also decreases, thus making it necessary to repeatedly pump the tank to maintain any sort of uniform pressure within the tank.

More recently, it has been proposed to pressurize sprayer tanks by discharging a liquid or gaseous propellant from a pressurized cartridge or canister into the tank. For example, prior art U.S. Pat. Nos. 3,109,558 issued Nov. 5, 1963 to Yetter and 3,262,609 issued July 26, 1966 to Poitras disclose and teach portable sprayers or spray tanks which are adapted to be charged or pressurized with the well-known propellant, dichlorodifluoromethane, commonly sold under the trademark Freon-12. However, the sprayer apparatus proposed in the aforesaid patents are either overly complicated in their construction, or are otherwise inefficient for their intended use. Thus, in the aforesaid Yetter patent, the liquid Freon propellant is metered by a pressure responsive valve from a supply canister into the spray liquid contained in the sprayer tank where it settles by gravity to the bottom of the tank. While a portion of the liquid propellant at the bottom of the tank vaporizes and percolates as a gas upwardly through the spray liquid to pressurize the ullage of the tank, at least some portion of the liquid propellant residing at the bottom of the tank will be sucked up into the discharge pipe and carried off and wasted each time the sprayer is operated. While the sprayer apparatus of the Poitras Patent eliminates the direct introduction of the liquid propellant into the liquid to be sprayed, it will be noted that in Poitras the propellant supply canister or cartridge positioned wholly within the sprayer tank and occupies space therein which might otherwise be devoted to an increased volume of spray liquid. Also, the Poitras patented sprayer utilizes a comparatively complicated and expensive pressure regulator valve to control the outflow of vaporized propellant from the supply canister into the ullage of the tank.

Summary And Objects Of The Invention

This invention provides an improved propellant-charging adapter designed to sealingly fit within the filler opening or mouth of a spray tank and to receive and hold thereon a pressurized cartridge or canister of liquid Freon-12 or comparable liquid propellant, and which includes an elongated heat exchanger tube or trap extending downwardly from the adapter body into the tank and terminating in a closed end closely adjacent the bottom of the spray tank. The heat exchanger tube or trap defines within the tank a straight, elongated, propellant-vaporization or boiling chamber which is in direct heat exchange contact with the spray liquid in the tank, and into which the pressurized liquid propellant is discharged from the supply cartridge or canister. The liquid propellant is caused to boil or vaporize in the tube or trap by heat derived from the spray liquid in contact with the outer wall of the tube or trap. The vaporized or gaseous propellant passes, by way of an outlet opening formed in the side wall of the tube near its upper end, into the ullage of the spray tank to pressurize the tank. When the pressure of the vaporized propellant reaches or exceeds the vapor pressure of the liquid propellant in the tube or trap, boiling or vaporization of the propellant ceases. However, as the level of the spray liquid in the tank recedes upon operation of the sprayer, the pressure of the vaporized propellant is momentarily reduced thus causing the liquid propellant in the trap to again boil and thereby restore the pressure within the spray tank. Thus, the presure within the tank is maintained substantially in equilibrium until the spray liquid is completely discharged from the tank. Preferably, the propellant charge in the supply cartridge or canister is an amount matched to the capacity of the spray tank and to the heat exchanger trap, so that the entire charge of liquid propellant will be deposited in the heat exchanger trap and will be completely vaporized at the same time as the last of the spray liquid is discharged from the tank.

The principal object of this invention is to provide a simplified, yet efficient, gas-pressurizing system for a liquid spray tank which includes an elongated, straight liquid propellant-receiving tube or trap arranged to extend almost to the bottom of the sprayer tank, so as to provide optimum heat transfer between the spray liquid in the tank and the highly volatile liquid propellant in the tube or trap.

Another object is to provide a gas-charging adapter for a liquid spray tank which is constructed to accept a readily available, conventional size Freon propellant cartridge or canister in inverted, upwardly projecting position above the top of the spray tank, and which is operable to maintain physical separation between the spray solution in the spray tank and the unvaporized liquid propellant while at the same time utilizing the heat of the spray solution to vaporize the liquid propellant and thereby maintain a substantially constant pressure within the tank.

Additional objects and advantages of the invention will become more readily apparent from a detailed consideration of the following description and the accompanying drawings.

DESCRIPTION OF PREFERRED EMBODIMENT OF THE INVENTION

Figure 1:
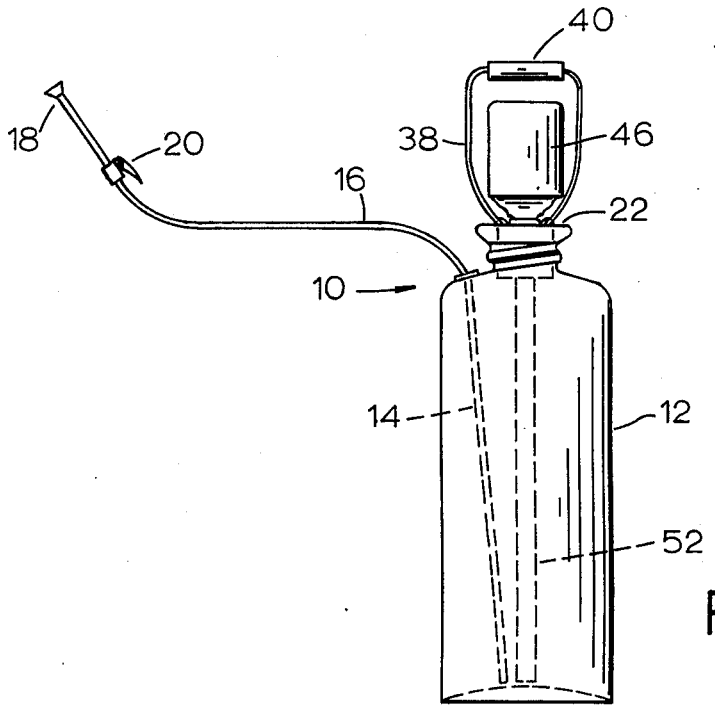
FIG. 1 is an elevational view of the sprayer of this invention.
Figure 3:
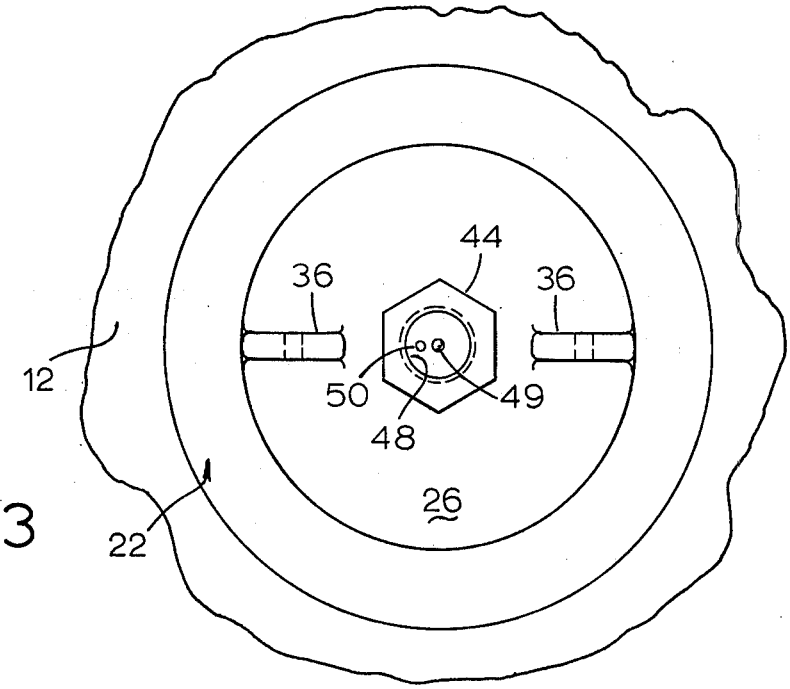
FIG. 3 is a fragmentary plan view of the top of the spraying apparatus without the propellant container or the handle.

The present sprayer apparatus is indicated generally at 10, and includes a conventional type spray tank 12, a rigid outlet tube 14 extending through and sealed in the top wall of the tank and terminating closely adjacent the bottom of the tank, a flexible hose 16 connected to the upper end of the outlet tube, a nozzle 18 connected to the other end of the hose and a manually operable valve 20 for controlling the discharge of pressurized liquid from the tank and nozzle 18.

Figure 2:
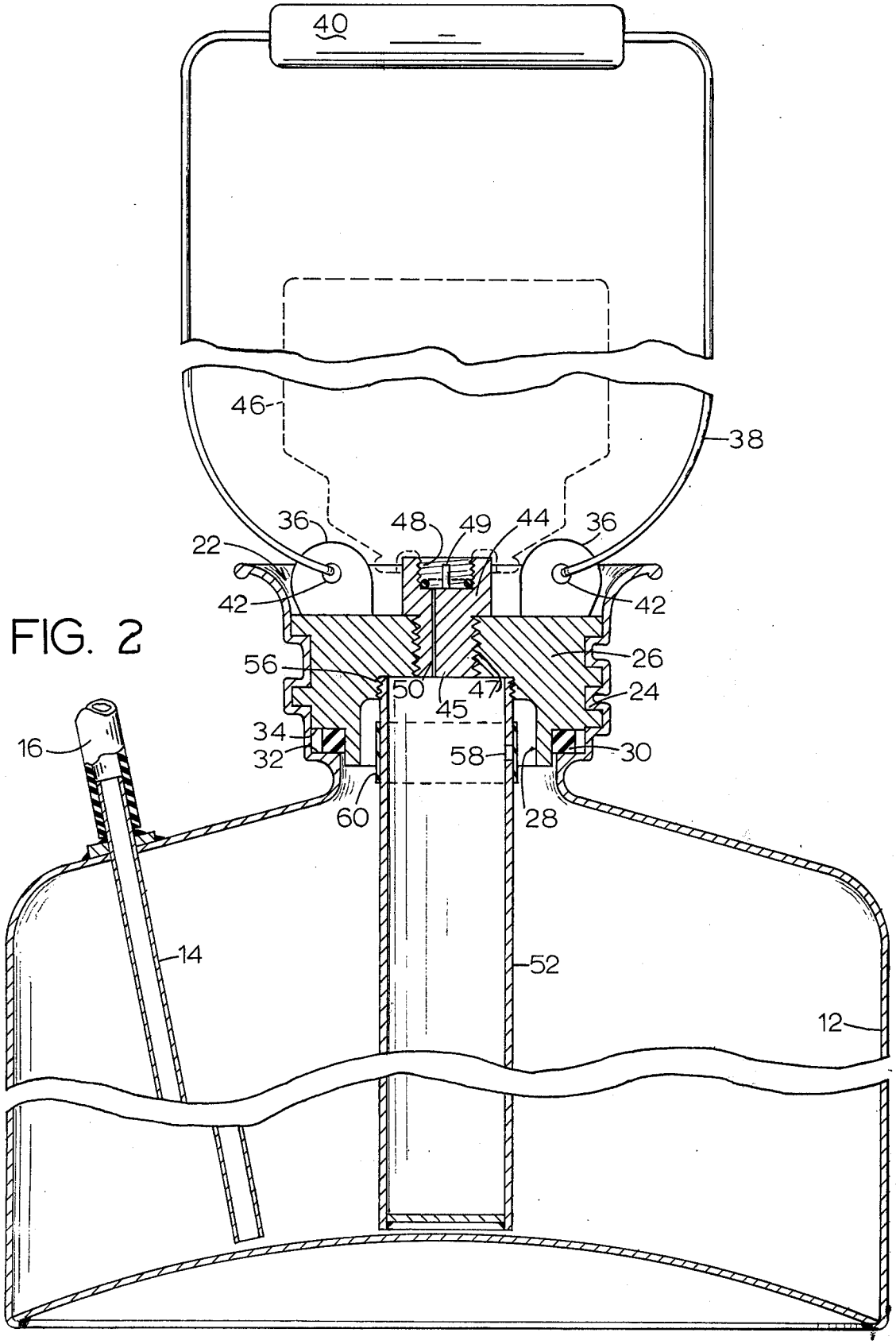
FIG. 2 is a fragmentary sectional view of the sprayer of FIG. 1.

With particular reference to FIG. 2, it will be seen that the top of the tank is formed with a central mouth or opening 22 which is threaded, as at 24, to receive a cooperatively threaded adaptor plug 26. The plug is formed below its threaded region with an annular skirt 28 on which is carried a sealing ring or gasket 30. When the plug 26 is fully threaded into the opening 22 the ring 30 is compressed between an inwardly extending annular shoulder 32 formed on the tank and a notched shoulder 34 formed on the plug 26 to provide a fluid tight seal between the plug and the interior chamber of the tank. The plug 26 is formed on its upper surface with a pair of wing nut-forming ears 36 to which are connected the lower ends of a wire bail 38. The bail carries a wood or plastic handle 40 and the lower opposite ends thereof are hooked through openings 42 formed in the ears 36. By this arrangement the tank may be transported easily by one hand.

A hexagonal nipple 44 projects upwardly from the center of the plug 26 and is formed with an externally threaded shank portion 45 carried in an internally threaded bore or socket 47 formed in the central portion of the plug 26. The hexagonal head portion of the nipple 44 is formed with a central, internally threaded socket 48 into which projects a seal-puncturing or rupturing pintle or needle 49, and a comparatively small diameter inlet orifice or passage 50 extends through the shank portion 45 to the socket 48 of the nipple 44.

The nipple 44 is thus adapted to receive the threaded outlet nipple of a conventional Freon cartridge or cannister indicated generally at 46. As will be understood, when the outlet nipple of the Freon cartridge 46 is threaded into the socket 48 of the nipple 44, the pintle 49 punctures the lid or seal of the cartridge and permits the liquid Freon propellant to flow under pressure through passage 50 into an elongated heat exchanger tube or propellant trap 52. A sealing O-ring 54 located within the nipple is designed to abut the face of the container 46 as it is threaded into the nipple to minimize leakage of the propellant, it being reconized that the Freon propellant would quickly vaporize if vented to the atmosphere because its normal vapor pressure is about 75 psi at approximately 16°C.

The propellant trap or heat exchange tube 52 is unitarily supported at its upper end in a threaded counterbore 56 formed in the plug 26. A vapor outlet opening or orifice 58 is formed in the side wall of the tube 52 adjacent its upper end and above the normal levels of the liquid contained in the tank. An elastic sleeve or band 60 may be placed around the tube 52 at the level of the outlet opening 58 for the purpose of blocking the entry of spray solution or other foreign matter from the tank into the tube 52, while at the same time permitting Freon vapor or gas to pass under pressure outwardly through the opening 58 into the ullage of the tank. In operation, the plug 26 with its depending propellant trap 52 may be removed from the container by thumb pressure on the ears 36, and the cleaning solution, or other spray liquid, may be poured or otherwise introduced in desired quantity to substantially fill the tank 12. The plug 26 is then tightly rethreaded into the mouth of the tank with the propellant trap or heat exchanger tube 52 extending well into the body of liquid within the tank.

It is desirable to use a minimum amount of propellant to completely discharge the contents of the tank under a desired minimum pressure. It has been found that a commercially available 15 oz. canister or can of Freon-12, such as is commonly employed to charge the refrigerant systems of automobiles, is sufficient to discharge 5 gallons of liquid at pressure of 40–60 psi. For smaller or larger capacity tanks, the charge of Freon-12 may be varied accordingly.

The nipple of the canister 46 is threaded into the socket 48 and the pintle 49 punctures the seal of the can so that the liquid Freon flows downward through passage 50 into the trap 52. The can 46 remains threaded into the nipple 44 until the tank is completely discharged, otherwise the propellant trap 52 would be vented to the atmosphere through passage 50.

As soon as the liquid Freon enters the trap 52 it begins to boil and the vapor or gas passes under comparatively high pressure outwardly through opening 58, displacing elastic sleeve 60, and into the ullage of the tank. The heat of vaporization for the propellant is supplied by the spray liquid through the walls of the trap, but the reduction in temperature of the spray liquid is insufficient to cause freezing thereof.

When the sprayer valve 20 is opened, liquid will be forced by the gas pressure in the ullage of the tank outwardly through tube 14, hose 16, and nozzle 18. As the liquid level within the tank recedes the gas pressure above the liquid will momentarily drop, but this results in more rapid boiling and vaporization of liquid Freon in the trap 52, until pressure is restored.

While the spraying operation is proceeding, the pressure above the liquid level will be maintained roughly in the range of 40–60 psi until the liquid is exhausted from the tank. Any excess of Freon gas in the tank may be vented to the atmosphere.

While a preferred embodiment of the invention has been shown and described in detail, it will be clear that modifications in design and details of construction may be made without departing from the spirit of the invention or the scope of the following claims.

I claim:

1. In combination with a sprayer tank having a top wall and a valve-controlled outlet conduit communicating with the interior of the tank adjacent the bottom thereof; a gas pressurization adapter for said tank comprising:

a. a connector fitting carried in the top wall of said tank and arranged to sealingly receive and support an inverted, liquid propellant supply cartridge above the top wall of said tank, said fitting having a propellant-conducting passage extending therethrough; and b. an elongated, propellant-receiving trap having an upper end communicating with the propellant-conducting passage of said fitting and a closed lower end portion extending downwardly into said tank for direct heat exchange contact with a spray liquid contained in said tank, said trap defining an elongated vaporization chamber into which a pressurized liquid propellant may be introduced by way of said fitting, and said trap being provided toward the upper end thereof with an outlet opening through which vaporized propellant may flow into the upper region of said tank.

2. The combination defined by claim 1, wherein said connector fitting comprises a plug detachably carried in the top wall of said tank and having an internally threaded nipple extending upwardly to receive an inverted propellant supply cartridge.

3. The combination defined in claim 1, wherein said plug is threadedly carried in a filler opening for said tank.

4. The combination defined in claim 2, wherein said propellant-receiving trap comprises an elongated, tube extending from said plug to a level closely adjacent the bottom of said tank and arranged for heat exchange contact with a liquid contained in said tank, said tube being closed at the lower end thereof and along its sides except for said outlet opening.

* * * * *